United States Patent [19]

Baker

[11] 4,329,682

[45] May 11, 1982

[54] PHASE CHANGE WARNING DEVICES

[75] Inventor: Michael J. Baker, Bedfordshire, England

[73] Assignee: Hawker Siddeley Dynamics Ltd., Hertfordshire, England

[21] Appl. No.: 940,176

[22] Filed: Sep. 7, 1978

Related U.S. Application Data

[63] Continuation-in-part of Ser. No. 682,342, May 3, 1976, abandoned.

[51] Int. Cl.[3] ..... G08B 19/02

[52] U.S. Cl. ..... 340/581; 62/140; 244/134 F

[58] Field of Search ..... 340/580, 581, 599, 27 R, 340/601; 62/128, 140, 151; 73/170; 244/134 R, 134 D, 134 F

[56] References Cited

U.S. PATENT DOCUMENTS

| | | | |
|---|---|---|---|
| 3,276,254 | 10/1966 | Richard | 340/581 X |
| 3,277,459 | 10/1966 | Werner | 340/581 |
| 3,305,851 | 2/1967 | Brandtszteter | 340/581 |
| 3,367,124 | 2/1968 | Beck | 62/128 X |
| 3,728,867 | 4/1973 | Jarrett | 62/140 |
| 3,782,130 | 1/1974 | Irvine | 62/128 |
| 4,007,603 | 2/1977 | Gustafsson | 62/151 |

*Primary Examiner*—John W. Caldwell, Sr.
*Assistant Examiner*—Daniel Myer
*Attorney, Agent, or Firm*—Howard L. Rose

[57] ABSTRACT

A method and apparatus is provided for detection of the onset of a physical change in state of a flowing fluid medium or component of a flowing fluid medium, e.g. freezing, boiling, sublimation, crystallization. A surface in contact with the fluid medium is maintained at a temperature that is an approximately fixed amount below or above the general stream temperature of the fluid, by means of a thermo-electric heat pump, the temperature difference being sensed by thermo-couple means to obtain a control signal for regulating the output of an amplifier that drives the heat pump. Upon occurrence of the physical change in state to be detected, the amplifier output will fall or rise rapidly as the system tries to regulate the power input to the pump to keep the temperature difference constant and this swing is detected by a signal generator monitoring the output of the amplifier.

13 Claims, 5 Drawing Figures

Figure 1:
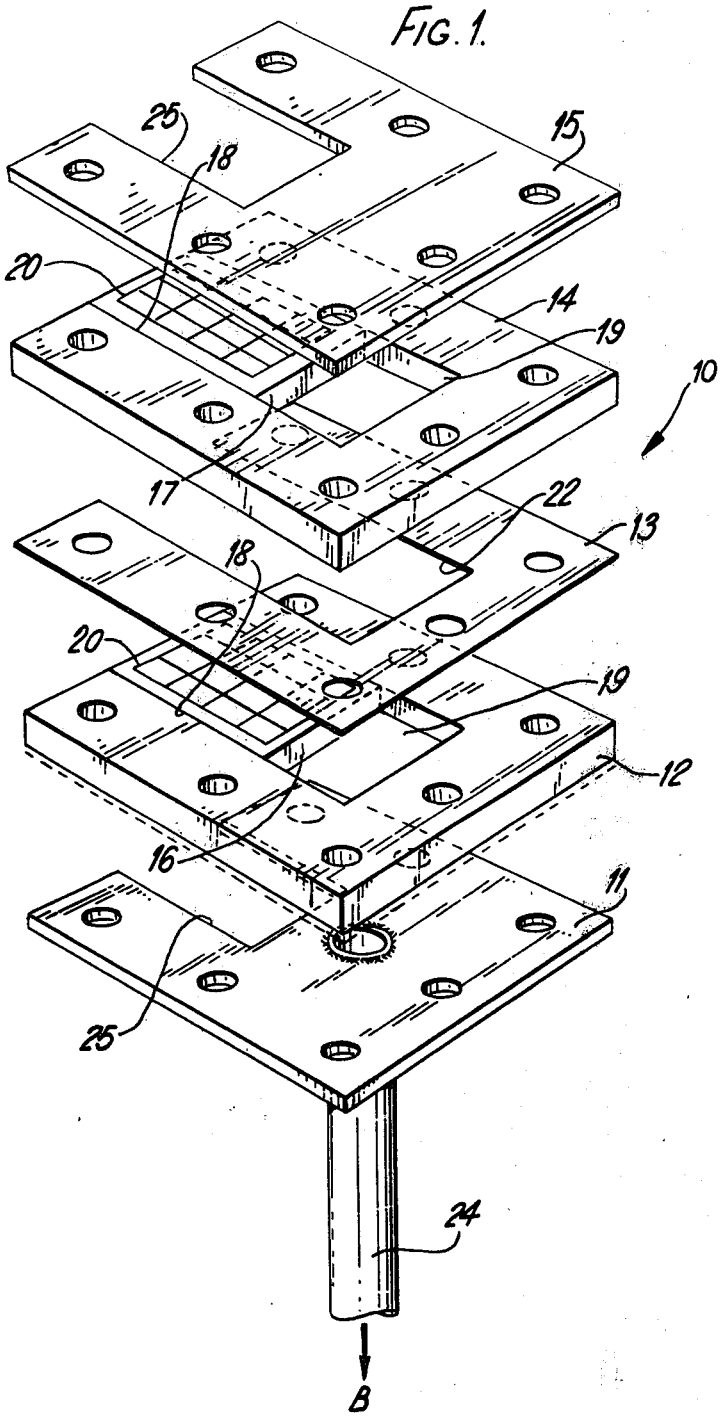

THERMOCOUPLE SIGNAL INPUT
30
AMP
21
OUTPUT TO HEAT PUMP
33
LOW AMPLIFIER POWER SIGNAL GENERATOR
SIGNAL TO AIR CONDITIONING CONTROL SYSTEM
32
31
POWER SUPPLY

PHASE CHANGE WARNING DEVICES

RELATED APPLICATION

This application is a continuation-in-part of my prior application for U.S. Pat. Ser. No. 682,342, filed May 3, 1976, now abandoned.

This invention relates to physical phase change warning devices and has particular though not exclusive application in providing warning of icing conditions in aircraft air conditioning systems.

There are two basic methods of monitoring the conditions in an airstream to give warning of ice formation. One method is to continuously monitor the relative humidity of the air and the temperature of the air. Warning is given when the relative humidity approaches 100% and the air temperature approaches 0° C. This invention uses the alternative method, i.e. the temperature of some suitable surface is depressed and some physical property that would be altered by the presence of ice on this surface is monitored. This property change due to ice formation must be discernible from changes caused by other agents such as water and dirt.

According to the present invention, a thermo-electric heat pump is arranged to establish a cold surface in the air stream with a temperature that is at some approximately fixed temperature difference, $\Delta T$, below the general airstream temperature. This may typically be achieved by providing a thermo-couple with one junction in intimate thermal contact with the cold surface, and the other junction arranged to sense the general airstream temperature. The output from this thermocouple is then used to control an amplifier. The output of the amplifier provides means to power the thermoelectric heat pump, while the control of this amplifier is arranged in such a manner that the temperature difference $\Delta T$ is kept nearly constant.

The power supplied by the amplifier should be clearly related to the heat transferred from the airstream to the cold surface. Since the temperature difference $\Delta T$ is approximately constant this implies that the amplifier output must be related to the overall heat transfer coefficient between the airstream and the cold surface.

Several factors may effect a marked change in the heat transfer coefficient between the airstream and the cold surface. The condensation of water or the freezing of ice upon the cold surface and the consequent release of latent heat would cause the overall heat transfer coefficient, and therefore the amplifier output, to rise. However, without actual temperature measurement, it would not be possible to differentiate between these phenomena. Such a rise in amplifier output should therefore be ignored. Following the initial freezing of ice upon the cold surface, an ice layer begins to build up. This partially insulates the cold surface from the airstream and so produces a reduction in the heat transferred to the cold surface and consequently a reduction in the amplifier output. This effect may be enhanced by arranging the cold surface such that a build up of ice upon the cold surface would cause a reduction of the ice surface area in contact with the airstream. For instance, when the cold surface is in the shape of the inside of a small tube through which an air sample is allowed to pass, the build up of ice can completely block the tube and thereby cause the amplifier output to drop to a very low value. Such a drop in amplifier output may be taken as an indication that ice has formed on the cold surface and may be used to generate a control signal to which the aircraft airconditioning system may respond.

As a preferred feature of the invention, instead of a tube the cold surface is formed as a narrow slit. This gives the result that it blocks quickly upon, e.g. icing, creating a sharp reduction in flow that causes a rapid change in heat transfer to signal the phase change. Conveniently, the device can be built up from a stack of plates with the slit formed by a gap between adjacent plates.

Figure 2:
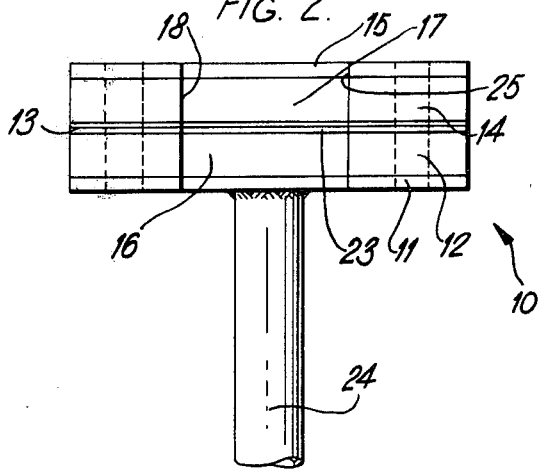
Figure 3:
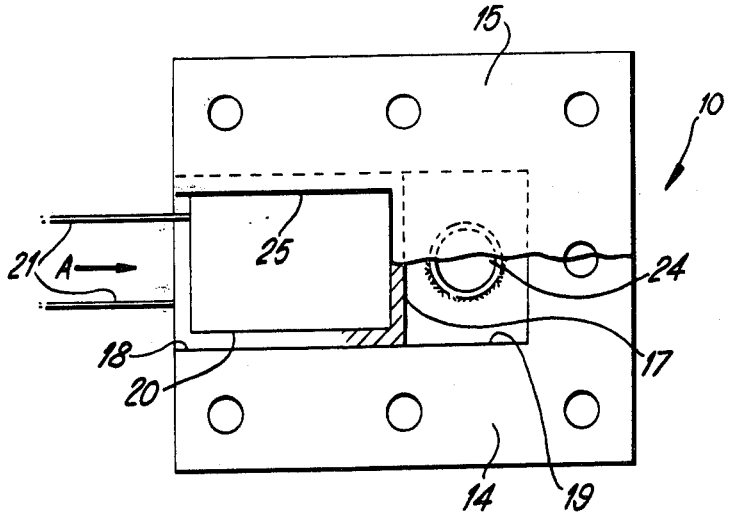
Figure 4:
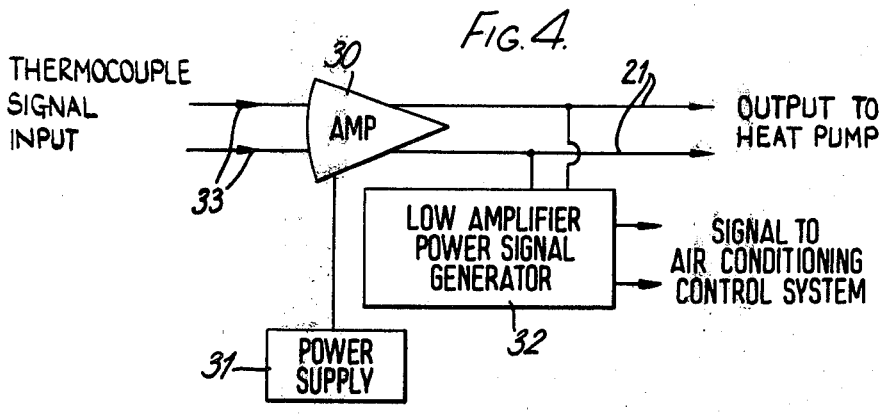
Figure 5:
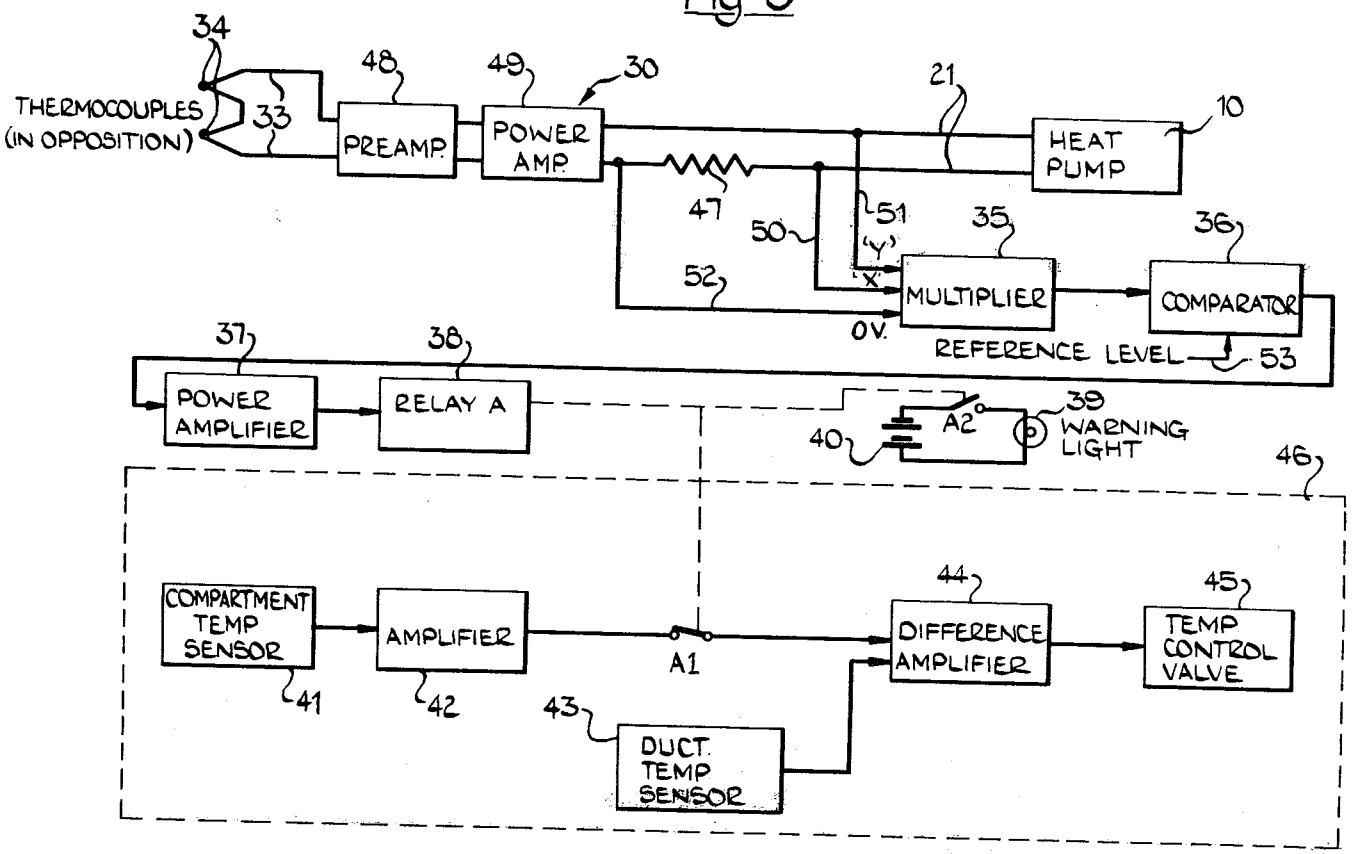

One arrangement of thermo-electric heat pump, for use in accordance with the invention in, e.g., an ice warning device for an aircraft airconditioning system, will now be described by way of example, with reference to the accompanying drawings, in which:

FIG. 1 is an exploded view of a stack of plates forming the heat pump to be described, FIG. 2 is an end elevation, FIG. 3 is a plan view, with the top plate removed in the lower half, FIG. 4 shows electrical circuitry to which the heat pump is connected, and FIG. 5 is an electrical and block diagram illustrating the operation of the overall system.

The thermo-electric heat pump 10 in FIGS. 1 to 3 of the drawings is constructed from a stack of plates, 11, 12, 13, 14, 15 held together by bolts (not shown). Plates 11 and 15 are bottom and top plates, respectively, between which are sandwiched thicker plates 12, 14 bearing semi-conducting heat pump elements 16, 17, and the plate 13 is a thin spacer or shim (of which there may be more than one) between the plates 12 and 14. The semi-conducting heat pump elements 16, 17 are blocks bonded into rectangular cut-outs 18 in the plates 12 and 14, the cut-outs 18 being longer than the blocks so as to leave open rectangular volumes 19 beyond the blocks inside the stack that form an interior chamber. The blocks 16, 17 have electrically-conducting electrode areas 20 applied to their upper and lower faces to which electrical leads 21 are connected, the electrode areas being insulated by painting over with varnish.

The shim plate or plates 13 space apart the plates 12, 14 and hence the semi-conducting heat pump blocks 16, 17 by a gap of, say, two thousandths of an inch and have a cut-out 22 matching in position and area the cut-outs 19 in the plates 12, 14. Hence a slit 23 is formed between the blocks 16, 17 for inflow (or outflow) or air (or other fluid) into the interior chamber formed by the volumes 19, as indicated by the arrow A. Outflow from this chamber (or inflow) is by way of a pipe 24 attached to the bottom plate 11, as indicated by the arrow B.

When the device is operating heat is pumped away from the air flowing through the slit 23 by the thermoelectric blocks 16 and 17 and any formation of ice crystals in the air blocks the narrow slit very quickly and causes a rapid reduction in flow through the device. The bottom and top plates 11, 15 have cut-outs 25 matching the blocks 16, 17 to allow ready cooling of the surfaces of the blocks to which the heat is pumped.

Referring now to FIG. 4, the output of an amplifier 30 is connected to drive the heat pump via leads 21. The amplifier is powered by an electrical power source 31 and its controlling input signal on leads 33 is derived from two thermo-couples, one being located in a position where it will sense the cold surface temperature in the slit 23 of the heat pump while the other thermo-couple is located where it will sense the general airstream temperature away from the influence of the cold surfaces of the heat pump. Thus, the input signal to the amplifier 30 will represent the aforesaid temperature difference $\Delta T$.

The amplifier 30 is an inverting amplifier with a high gain in the order of $10^6$. If $\Delta T$ decreases the amplifier output increases and vice versa. If the heat pump slit 23 blocks with ice the effect of the airstream warming the cold surface will be removed and $\Delta T$ will try to increase rapidly thereby rapidly reducing the power output of the amplifier. The output level of the amplifier 30 is monitored by a signal generator 32 receiving an input from the leads 21. This signal generator itself generates an output signal when the output of the amplifier drops to a predetermined level, which signal can be employed, for example, in an air-conditioning control system or to trigger a warning device.

FIG. 5 illustrates the operation of the overall system. The two thermocouples 34 are connected in series opposition between the input lines 33 which feed the amplifier combination 30 consisting of a preamplifier 48 and a power amplifier 49. A suitable preamplifier with a gain in the order of $10^5$ can be that designated as LH0041CJ and manufactured by National Semiconductor Corporation of 2900 Semiconductor Drive, Santa Clara, Calif. 95051, U.S.A.; the power amplifier 49 is an entirely conventional power output stage with a gain in the order of 10.

The signal generator 32 of FIG. 4 is shown in FIG. 5 to comprise a multiplier 35, a comparator 36, a power amplifier 37 and a relay 38. The multiplier 35 receives as one input a signal on lines 50 and 51 representing the voltage between the output leads of the amplifier 30; a second input signal on lines 50 and 52 represents the current output of the amplifier 30, being picked off from the two terminals of a resistor 47 connected in series in one output lead of the amplifier. The multiplier 35 multiplies these two signals, representing voltage and current respectively, to obtain a signal representing the power output of the amplifier 30 which is then applied to the comparator 36 where it is compared with a reference level on lead 53. The signal resulting from this comparison is amplified in power amplifier 37 and applied to the relay 38. When the relay is energized it opens relay contacts A1 and closes relay contacts A2.

In FIG. 5 there is also shown a typical temperature control system 46 for controlling cold air flow through a duct into a compartment to be air-conditioned. The system comprises a temperature sensor 41 for sensing the temperature in the compartment to be air-conditioned, an amplifier 42 for amplifying the signal from the temperature sensor 41, a temperature sensor 43 for sensing the temperature of the air in the air duct, a difference amplifier 44 receiving as one input the output of the amplifier 42, and as a second input the signal from the duct temperature sensor 43, and a temperature control valve 45 controlling the flow of air in the duct and responsive to the output of the difference amplifier 44. Such air temperature control systems are conventional and the system 46 is not described in more detail as it forms no part of the present invention. The system 46 is only illustrated to show how the control of the valve 45 is made subject to the intervention of the system according to the invention, in that the relay 38 can open and close the switch contacts A1 in the lead line between the amplifier 42 and the respective input of the difference amplifier 44, thereby respectively interrupting or applying the signal from the compartment temperature sensor 41.

At the same time as the contacts A1 are opened, the contacts A2 are closed by the relay 38 so that a warning lamp 39 is energized from an electrical source 40.

An advantage of the system is that, when the slit 23 of the thermoelectric heat pump has become blocked with ice, the direction of thermo-electric heat pumping can be reversed to melt the ice and clear the slit rapidly.

However, it will be understood that, while the invention has been described in the context of an airconditioning system, especially an aircraft airconditioning system, there are many other fields in which it could be employed, such as in the provision of warning of the precipitation of some fractions of crude oil in oil pipe lines.

Alternatively, if a rise in amplifier power is used to generate an appropriate signal, a warning device results which could be used to give warning of the condensation of some fraction, in a gas flow.

Furthermore, if the direction of the heat pump is reversed so that the surface or surfaces in contact with the flowing stream are hotter, instead of colder, than the general stream temperature, and the temperature difference between the hot surface and the fluid flow is controlled in a manner similar to that already described in the control of the ice warning device, a resultant rise in amplifier output may be used to generate an appropriate signal, giving warning of the imminent boiling of a liquid.

A device according to the invention can also be used in or on aircraft to detect the freezing of moisture in the ambient air.

What I claim is:

1. A method of obtaining an indication of the onset of a change of physical state in a flowing fluid, said method including the steps of:

(a) directing a portion of said fluid into contact with a surface;

(b) utilizing electrical energy for thermo-electrically heat pumping said surface to maintain a constant temperature difference between said surface and said flowing fluid;

(c) monitoring the electrical energy utilized to maintain said constant temperature difference; and (d) providing said indication when the monitored electrical energy changes in a predetermined manner.

2. The method according to claim 1 wherein step (b) includes:

(e) sensing the temperatures at said surface and in said flowing fluid;

(f) deriving a control signal corresponding to the difference between the temperatures sensed in step (e); and (g) controlling the amount of electrical power applied to heat pump said surface as a function of said control signal.

3. The method according to claim 1 wherein said change of physical state involves deposition of a solid on cold surfaces, and wherein step (a) includes passing said portion of said fluid through a duct in which said surface is located such that deposition of said solid on said surface blocks flow through said duct.

4. A method according to claim 3 including the further step of reversing the direction of thermo-electric heat pumping when the duct is blocked thereby to clear the solid rapidly from the duct.

5. A physical phase change warning device to provide an indication of the onset of a change of physical phase in a flowing fluid, said device comprising:

a surface disposed in contact with a portion of said fluid;

thermo-electric heat pump means for controlling the temperature of said surface;

means for supplying electrical power to said thermo-electric heat pump means;

control means for controlling said electrical power to maintain a constant temperature difference between the temperature at said surface and the temperature of said flowing fluid; and output means for providing said indication in response to a predetermined change in the electrical power supplied to said thermo-electric heat pump means.

6. The device according to claim 5, said control means comprising:

a thermo-couple having a first junction positioned to sense the temperature at said surface and a second junction positioned to sense the temperature of said flowing fluid, said thermo-couple providing a control signal as a function of the temperature difference between said surface and said flowing fluid; and amplifier means responsive to said control signal for applying said electrical power to said thermo-electric heat pump means as a function of said temperature difference.

7. The device according to claim 6 wherein said change of physical phase is the deposition of a solid on said surface and wherein said output means comprises signal generator means for:

monitoring the electrical power applied by said amplifier means; and delivering an output signal when the applied electrical power falls below a predetermined level.

8. The device according to claim 7 wherein said surface partly defines a duct which is in the form of a slit whereby said duct becomes rapidly blocked by said solid deposited on said surface.

9. The device according to claim 8 wherein said amplifier means includes means responsive to a change in said control signal representing blockage of said duct for applying said electrical power to said surface in a sense to heat said surface and clear said deposited solid therefrom.

10. The device according to claim 6 wherein said flowing fluid is a gas, wherein said change of physical phase is the deposition of liquid onto said surface, and wherein said output means comprises signal generator means for:

monitoring electrical power applied by said amplifier means; and delivering an output signal when the applied electrical power rises above a predetermined level.

11. The device according to claim 6 wherein said flowing fluid is liquid, wherein said change of physical phase is incipient boiling at said surface, and wherein said output means comprises signal generator means for:

monitoring electrical power applied by said amplifier means; and delivering an output signal when the applied electrical power rises above a predetermined level.

12. The device according to claim 5 wherein said surface is a cold surface of said thermo-electric heat pump means and is a wall of a slit through which said portion of said fluid flows.

13. The device according to claim 12, wherein the thermoelectric heat pump means includes:

a stack of plates;

semi-conducting heat pump elements located in said stack, said elements being separated by a gap to form said slit and permit fluid flow between said elements.

* * * * *